United States Patent [19]

Lutz

[11] Patent Number: 4,598,474

[45] Date of Patent: Jul. 8, 1986

[54] METHOD OF MAKING AN ELECTRICAL PLUG CONNECTION

[75] Inventor: Gerhard Lutz, Erlangen, Fed. Rep. of Germany

[73] Assignee: Siemens Aktiengesellschaft, Munich, Fed. Rep. of Germany

[21] Appl. No.: 619,393

[22] Filed: Jun. 11, 1984

Related U.S. Application Data

[63] Continuation of Ser. No. 105,218, Dec. 19, 1979, abandoned.

[30] Foreign Application Priority Data

Dec. 28, 1978 [DE] Fed. Rep. of Germany ..... 2856497

[51] Int. Cl.[4] ..... H01R 43/04

[52] U.S. Cl. ..... 29/863; 29/884; 339/47 R

[58] Field of Search ..... 29/859, 861, 862, 863, 29/884; 339/256 SP, 258, 47 C

[56] References Cited

U.S. PATENT DOCUMENTS

| | | | |
|---|---|---|---|
| 2,744,244 | 5/1956 | Schumacher | 339/47 R |
| 3,157,449 | 11/1964 | Hennessey | 29/884 X |
| 3,169,814 | 2/1965 | Collins | 339/258 S X |
| 3,455,022 | 7/1969 | Schmitz, Jr. | 29/859 |
| 3,618,207 | 11/1971 | Sand et al. | 29/884 X |

FOREIGN PATENT DOCUMENTS

| | | | |
|---|---|---|---|
| 695377 | 9/1965 | Italy | 339/47 C |

*Primary Examiner*—Howard N. Goldberg
*Assistant Examiner*—Carl J. Arbes
*Attorney, Agent, or Firm*—Kenyon & Kenyon

[57] ABSTRACT

In an electrical plug connection comprising two matching elements which can be detached at any time, in order to avoid the difficulties of pushing one element on to the other during the assembly of a piece of equipment and the uncertain contact pressure which results by doing so, the matching elements are connected to form a plug unit, which can later be detached, as part of the manufacturing operation thereby insuring good alignment when they are pushed together and guaranteeing proper contact pressure.

4 Claims, 2 Drawing Figures

METHOD OF MAKING AN ELECTRICAL PLUG CONNECTION

This application is a continuation of application Ser. No. 105,218, filed 12/19/79 now abandoned.

BACKGROUND OF THE INVENTION

This invention relates to electrical plug connections consisting of two matching elements in general and more particularly, to an improved method of forming such plug connections during the construction of electrical equipment.

Detachable electrical connections formed by flat plugs and flat sockets, in which typically the flat plug is mounted to a terminal strip or board, and a socket matching it is crimped onto the end of a wire, and then pushed on the plug, are well known. Typically, when building electrical equipment where detachable connections of this nature are needed, the flat plugs are fastened in the required number and arrangement on a terminal strip. The wires which are to be connected to these flat plugs are cut to length and stripped at their ends. The socket which fits over the flat plugs is then crimped onto the end of the wire. Crimping can be done manually with pliers or with special crimping tools. Typically, such crimping is done in table presses in which the flat socket is supplied on a conveyor and the wire inserted by hand, after which it is crimped. During assembly, the socket on the end of the appropriate wire is then pushed on to the flat plug at the terminal strip in order to establish the connection. This operation of pushing the socket on to the plug is normally done by hand, possibly with the aid of a tool.

The socket must, of course, contact the flat plug with sufficient force to make a good connection. In some cases the forces required for pushing the socket on to the flat plug are quite large. In many cases because of the inadequate tools used for pushing the socket on, faulty electrical connections can result. In order to make a good connection it is necessary that the socket be correctly aligned with the plug. In other words, the socket should be pushed on with a force which is directly in the plane of the plug. If there is tilting, an improper alignment and bending of the portions of the socket which make contact with the plug can occur resulting in a faulty electrical connection with an excessive increase of the contact resistance.

SUMMARY OF THE INVENTION

It is the object of the present invention to avoid the problem which occurs because of sockets being inserted on the plugs improperly and the poor contact which can result because of this. In accordance with the present invention, in order to solve the problem, the two matching elements, e.g., the flat plug and the flat socket are assembled during manufacturing. In other words, the sockets are placed onto the plugs in a manufacturing operation where an exact control of the alignment between the plugs and the sockets is possible. The wires are not connected to the sockets at this point. Connection of the wires takes place later during assembly of the equipment. Although in the illustrated embodiment a flat plug and flat socket are shown, the invention is equally applicable in any arrangement where a detachable connection in the form of mating elements to at least one of which a wire is crimped, is used.

DETAILED DESCRIPTION OF THE INVENTION

Figure 1:
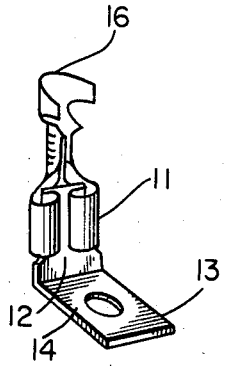
FIG. 1 is a perspective view of a single flat plug and socket.

As noted above, the present invention is applicable to various types of detachable connections where one has mating elements, e.g., a plug and socket with a wire crimped on to at least one of the two elements of the detachable connection. In the illustrated embodiment, a flat plug and mating socket are shown as examples. Thus, shown on FIG. 1 is a flat socket 11 which is pressed over the plug portion 12 of a terminal 13. Terminal 13 contains a hole 14 for mounting it to a terminal strip. The socket 11 contains on its end a portion 16 which can be crimped about a wire in conventional fashion.

Figure 2:
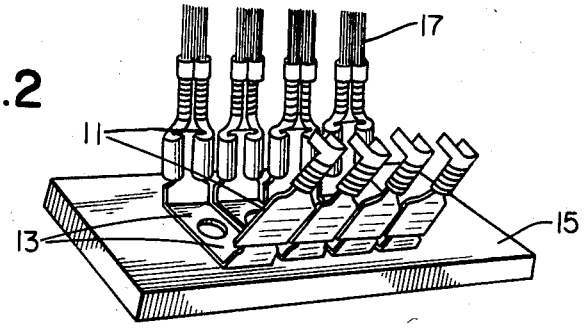
FIG. 2 is a perspective view of a plurality of plugs and sockets mounted on a terminal strip showing wires connected to some of the sockets.

FIG. 2 shows a plurality of terminals 13 mounted on a terminal strip 15. The terminals shown are double ended terminals 13 with a plug portion 12 on each side thereof. In accordance with the present invention, as part of the manufacturing operation in producing the terminals 13 and the sockets 11, the sockets 11 are automatically pressed on to the plug portions of the terminal 13. Thus, one ends up with a unit looking like what is shown in FIG. 1. Alternatively, the insertion could be done after the terminals 13 were mounted to a terminal strip 15 as shown in FIG. 1. In either case, however, the sockets are automatically pushed on to the plugs 12 in a controlled manner so that perfect alignment always takes place, insuring the proper contact pressure between the plug 12 in the socket 11. Thus, the critical operation of pushing the socket on to the plug takes place under controlled conditions avoiding the problems associated with pushing it on by hand. Since only approximately 10% of the sockets will ever have to be removed from their plugs for repair or maintenance purposes, over the life of the equipment, the present method is a great advantage in insuring proper contact pressure. Once the terminal strip 15 is assembled to the equipment with which it is to be used, the wires 17 are cut and stripped and placed in the sockets 11 with the portion 16 crimped thereabout using pliers or a crimping tool.

What is claimed is:

1. A method for the manufacture of a detachable electrical plug connection which is made up of a flat socket and a flat plug comprising connecting the flat plug and flat socket during the forming thereof and prior to the connection of any wire to either the plug or socket to form a plug unit which can later be detached again.

2. The method according to claim 1, comprising carrying out the connecting of said elements using automatic equipment to insure controlled and accurate alignment.

3. In a detachable electrical plug connection consisting of two matching elements, in the form of a flat plug and a flat socket, in which, to establish the detachable connection: the elements are formed in a manufacturing operation, one of the elements is attached to a terminal strip, a wire is crimped onto at least one of the elements, and the flat plug and flat socket are pushed together to make the connection, the improvement comprising: carrying out the step of pushing the flat plug and flat socket together during the manufacturing operation, at essentially the same time said elements are formed and before the crimping of a wire to either element, in order to form a detachable plug unit which can later be detached.

4. The method according to claim 3 comprising carrying out said step of pushing with automatic equipment to insure controlled and accurate alignment.

* * * * *